United States Patent [19]

Jacobs et al.

[11] Patent Number: 4,863,775

[45] Date of Patent: Sep. 5, 1989

[54] GARMENT WASH FINISH FOR DENIM

[75] Inventors: Robert D. Jacobs; Edward J. Davis, both of Dunn, N.C.

[73] Assignee: Burlington Industries, Inc., Greensboro, N.C.

[21] Appl. No.: 270,452

[22] Filed: Nov. 7, 1988

Related U.S. Application Data

[63] Continuation of Ser. No. 900,690, Aug. 27, 1986, abandoned.

[51] Int. Cl.[4] ..... B32B 3/02; B32B 33/00

[52] U.S. Cl. ..... 428/91; 428/89; 28/163; 66/195; 26/28

[58] Field of Search ..... 8/138, 139, 147; 428/91, 258, 259, 88, 89; 66/195; 26/28; 28/163

[56] References Cited

U.S. PATENT DOCUMENTS 4,000,342 12/1976 Rochelle et al. ..... 428/88

*Primary Examiner*—Paul Lieberman
*Assistant Examiner*—John F. McNally
*Attorney, Agent, or Firm*—Nixon & Vanderhye

[57] ABSTRACT

It is possible to produce denim fabric suitable for manufacture into garments that have the look and feel of washed and tumble dried garments, practiced in a relatively simple and quick manner. Denim fabric is treated to raise the warp yarns so that the warp yarns are adjacent the face of the fabric and positioned so that they can be rubbed and abraded to loosen the surface fibers; and then effecting abrading and rubbing of the tips of the warp crimp so as to duplicate the surface abrasion of washing and tumble drying without making a napped or brushed type finish or face. The abrading action may be practiced by sanding utilizing a fine sandpaper in the range of about 50–100 grit, employing a 9-roll T-Ralph sander with 2 to 6 rolls running at a speed of about 50 ydm. The fabric is lightly singed prior to the raising action, and the raising is accomplished by scouring with a blend of phosphated esters; open-width washing through about 5–10 wash boxes at speeds of about 30–80 yards per minute; effecting first and second rope washings of about 15–25 minutes each, the first at about 180° F. and the second at about 140° F.; drying under tension; finishing utilizing wetters and softeners; and Sanforizing® (compressively shrinking). After the abrading step, the fabric is shrunk to stabilize it to a 0–2 percent warp shrinkage range.

30 Claims, 1 Drawing Sheet

FIG. 1
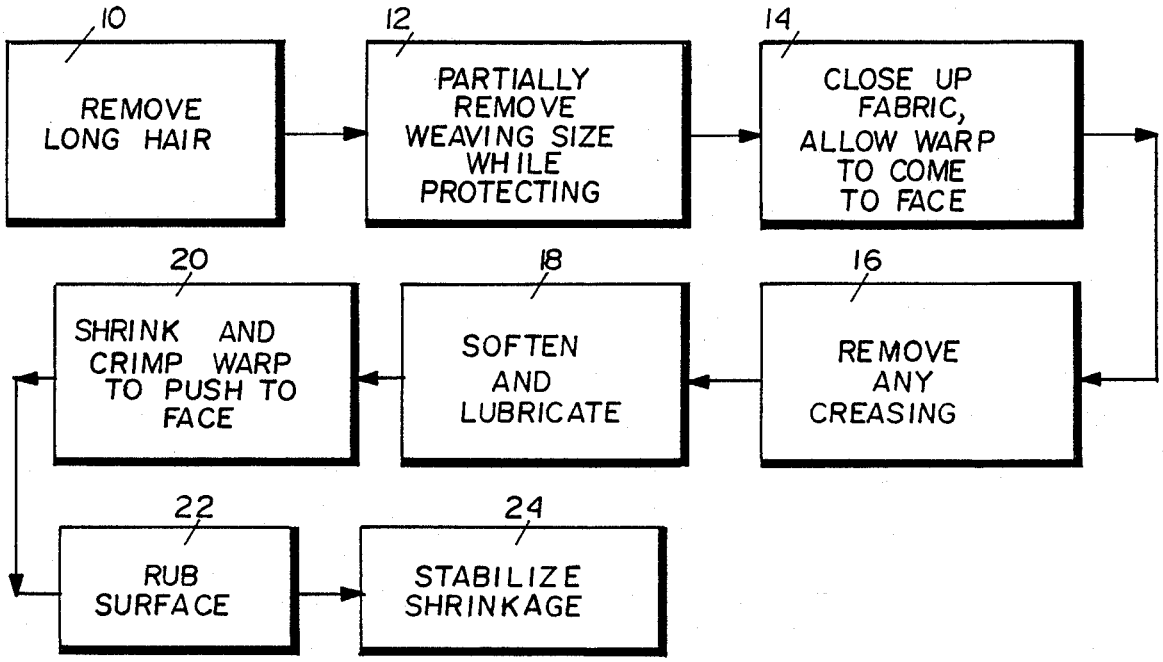
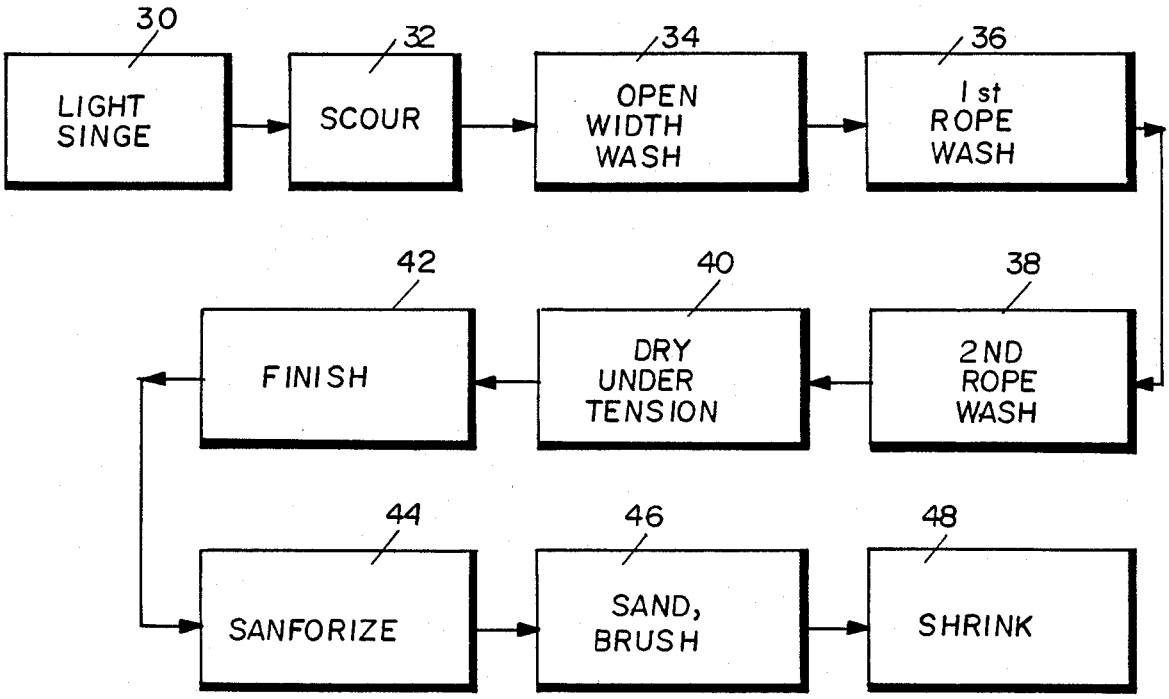
FIG. 2

GARMENT WASH FINISH FOR DENIM

This is a continuation of application Ser. No. 06/900,690, filed Aug. 27, 1986, now abandoned.

BACKGROUND AND SUMMARY OF THE INVENTION

It has long been considered desirable to produce a denim fabric, suitable for manufacture into garments such as pants and jackets, which has the look and feel of washed and tumbled dried garments. In the past, denim has been finished with a starch finish on top of the size used for weaving. The finished denim is shipped to a cutter as a stiff, heavy fabric, and the cutter in turn cuts the stiff fabric and sews it into the garments. The garments were either sold in this condition, or the garments themselves were washed, softened, reconditioned by steaming, pressing or ironing, resized, and sold. These latter steps were taken, of course, to simulate the look of a home laundered garment, but involved very expensive and time consuming procedures.

According to the present invention, it is possible to produce denim fabric, which fabric is suitable for manufacture into garments, which duplicates the look and feel of washed and tumble dried garments, and which can be produced in a relatively inexpensive and quick procedure compared to the prior art treatment of already completed garments, as described above. There have been numerous attempts to achieve the desired results according to the invention, which have only been of limited success. While commercial quantities of fabric have been produced by such prior techniques, they have not achieved the acceptable results that have been achieved according to the invention. The unsuccessful prior art procedures have normally involved the steps of singeing, then brushing or otherwise abrading the fabric, open-width washing and rope washing it, finished, Sanforizing® (compressively shrinking), and singeing it.

According to the present invention it has been found that in order to achieve desired results, it is necessary to raise the warp yarns to the face of the fabric before subjecting it to the abrading action. Once the warp yarns have been pushed to the face of the fabric, and properly positioned for presentation to a surface abrading action, they are acted upon (such as by a fine sandpaper in the range of about 50–100 grit) so as to duplicate the surface abrasion action of washing and tumble drying, but without making a napped or brushed type of face.

According to the present invention, the action of raising the warp yarns is effected by: Scouring the fabric with a blend of phosphated esters. Open-width washing of the fabric. Effecting first and second rope washing of the fabric to complete the removal of detergent and size from the cloth, while still leaving an amount of starch and other non-fibrous materials in the range of about 1.5–3.5 percent to ensure good hand development and thickness. Drying the rope-washed fabric under tension to flatten out rope marks and to remove creases. Finishing the fabric with a formulation including a wetter and a softener. Sanforizing® (compressively shrinking) the fabric. Abrading the tips of the warp crimp of the fabric without making a napped or brushed type of finish or face. And, shrinking the fabric to stabilize it at no more than 3 percent×3 percent warp and filling shrinkage.

The abrading action may be accomplished utilizing a 9 roll T-Ralph sander with only 6 rolls running at a speed of 50 ydm. After sanding, the fabric is shrunk to stabilize the fabric at no more than 3 percent×3 percent warp filling shrinkage; that is to stabilize the processed fabric to a 0 to 2% percent warp shrinkage range.

Practicing the invention, an exceptionally desirable denim fabric is produced, which, when made into garments may be more easily handled so that the garment manufacture can be quicker and more simple, and the final garments that are produced effectively duplicate home laundered and tumble dried garments. Garments produced utilizing the fabric according to the invention being produced in a less expensive and less time consuming manner than garments produced in the prior art in a manner which simulated home laundering and tumble drying.

It is the primary object of the present invention to provide for the effective duplication of a home laundered and tumbled dried look for garments made from denim fabric. This and other objects of the invention will become clear from an inspection of the detailed description of the invention, and from the appended claims.

BRIEF DESCRIPTION OF THE DRAWINGS

FIGS. 1 and 2 are schematic diagrams illustrating exemplary process steps that are followed in the practice of an exemplary method according to the present invention, for producing garments according to the invention.

DETAILED DESCRIPTION

FIG. 1 schematically illustrates the practice of an exemplary method according to the present invention indicating the function of various steps that are performed. FIG. 2 schematically illustrates the practice of a method according to the invention wherein the preferred steps are identified by their common terminology, rather than the functional terminology for the steps illustrated in FIG. 1.

With respect to FIG. 1, the first step that is preferably practiced in furtherance of the method according to the invention is the removal of long hair, and only long hair, from an already woven denim fabric, e.g. one having a weight from about 4 oz. to about 17 oz. (e.g., 14–3/4 oz.) The step 10 preferably is practiced by lightly singeing the fabric.

In the practice of the method according to the invention it is necessary to raise the warp yarns, that is to push them to the face of the fabric to a greater extent than loom state denim fabric, so that only the tips of the raised crimp or loops can be acted upon. The raising action is accomplished by practicing the sub-steps indicated by boxes 12, 14, 16, and 18 in FIG. 1.

In sub-step 12, partial removal of weaving size is achieved, in addition to partial removal of non-fibrous portions of the fabric, while the physical look and characteristics of the fabric are protected. Sub-step 12 is preferably practiced by first scouring the fabric with a blend of phosphated esters, and then subjecting it to open-width washing. One particular procedure that may be utilized is to employ Bi-Chem Scour DAG-2 blend of phosphated esters, in a concentration range of about 0.25%–1% at a temperature range of about 140° F.–200° F. This is followed by open-width washing utilizing about 5–10 wash boxes, and at speeds of about 30–80 yards per minute.

In sub-step 14, rinsing of the detergent and size from the fabric, while still leaving an amount of starch and other non-fibrous materials in the range of about 1.5–3.5 percent in order to ensure good hand development and thickness, is practiced. The fabric is closed up, while the dyed warp is allowed to shrink and come to the face of the fabric. This sub-step 14 preferably is accomplished by subjecting the fabric to a first rope wash at a temperature of about 180° F. for a period of about 15–25 minutes, and then subjecting it to a second rope wash at about 140° F. for about 15–25 minutes. The rope washing establishes the proper crimp exchange between warp and filling, and starts crimping of the warp yarns to the face of the denim fabric.

In sub-step 16, any creases introduced by the rope washing are removed. Sub-step 16 is practiced by drying the fabrics under controlled, significant, tension, to flatten out rope marks and to remove any creases.

In sub-step 18, the fabric is softened and lubricated. This gives the fabric the proper touch, and allows it to be subsequently compressively shrunk properly. The sub-step 18 is preferably practiced utilizing a finishing formula including a wetter and a softener. One suitable finishing formula that may be utilized is 6 pounds of Bi-Chem Wetter RW, 160 pounds of Bi-Chem Softener SAT, 8 ounces of Bi-Chem Anti-Foam CK-2, which together produce 250 gallons of finishing formulation. Wetter RW is a non-ionic ethoxylate nonyl phenol and ethoxylated coco amine plus ethylene oxide. The wetter RW allows the fibers to wet out uniformly before shrinking. The softener SAT is a blend of cationic fatty acid, amino ethyl ethanol amine, fatty amide salt mixture, silicone, and an ethoxylated nonyl phenol. The softener SAT gives smoothness and softness to touch.

After sub-step 18, the warp yarn raising action is concluded by practicing sub-step 20, in which the warp yarns are further shrunk and crimped to push them to the face of the fabric and to properly position them for presentation to the subsequent abrading machinery. Sub-step 20 is preferably accomplished utilizing a conventional compressively shrunk procedure.

After the practice of steps 12 through 20, the warp yarns will be properly positioned at the face of the denim fabric. Then step 22 will be practiced, in which the tips of the warp crimp will be rubbed and abraded to loosen the surface fibers in the warp yarn to duplicate the surface abrasion of washing and tumble drying, but without making a napped or brushed type of finish or face. The surface rubbing step 22 can be practiced utilizing a number of different abrading machines or devices, such as wire brushes, napping rolls, emery cloth, or sandpaper. One particularly effective procedure is to sand the tips of the warp crimp on a 9 roll T-Ralph sander with 2 to 6 rolls running at a speed of about 50 ydm. A fine sandpaper is utilized, that is having a range of about 50–100 grit. As previously mentioned, other abrading materials comparable to a fine sandpaper in the range of about 50–100 grit, may alternatively be utilized.

A "T-Ralph" sander is a sanding machine of the type manufactured by T-Ralph and Son, Inc. of Erwin, N.C.

After the abrading action in step 22, the final step that is desirable is the final shrinkage of the fabric to stabilize the fabric at no more than 3 percent×3 percent warp and filling shrinkage. The final shrinkage step 24 may be practiced utilizing any conventional technique, which allows stabilization of the processed fabric to a 0–2 percent warp shrinkage range.

After the practice of step 24, the denim fabric that results may be easily manufactured into garments, such as pants and jackets, and the final garments that are produced duplicate the appearance of, and the touch of, garments which have been home laundered and tumble dried.

FIG. 2 illustrates schematically basically the same steps as in FIG. 1, only instead of presenting the steps functionally, it sets forth the preferred steps according to the invention, as indicated by their common names. That is in the exemplary method of FIG. 2, the garment-weight denim fabric is first subjected to a light singe step 30, then a scouring step 32, and an open-width wash step 34, the steps 32 and 34 preferably being comparable to the details of the step 12 described above. Then the garment is subjected to first and second rope washes 36, 38, respectively, and then is dried under tension at station 40, the steps 36, 38, 40 being comparable in detail to the steps 14 and 16 described above. Then the denim is finished at station 42, comparable to the softening and lubricating step 18 described above, and compressively shrunk at step 44. The tips of the warp yarn on the face of the fabric are then abraded, as by the sanding or brushing steps 46 illustrated in FIG. 2, and then the fabric is subjected to the final shrink to stabilize it at station 48.

It will thus be seen that according to the present invention, a method is provided for the production of denim fabric suitable for manufacture into garments, such as pants and jackets, which have the feel and look of denim garments that have been home laundered and tumbled dried. While the invention has been herein shown and described in what is presently conceived to be the most practical and preferred embodiment thereof, it will be apparent to those of ordinary skill in the art that many modifications may be made thereof within the scope of the invention, which scope is to be accorded the broadest interpretation of the appended claims so as to encompass all equivalent procedures and products.

What is claimed is:

1. A method of producing denim fabric that has an overall look and feel of a denim garment that has been laundered, comprising, in sequence, the steps of:

(a) raising only the warp yarns of a piece of already woven denim fabric over substantially the entire surface of the fabric so that the warp crimp or loops are at the face of the fabric to a greater extent than loom state denim fabric, and (b) abrading only the tips of the raised crimp or loops to duplicate the surface abrasion of washing and tumble drying without making a napped or brushed type of face.

2. A method as recited in claim 1 wherein step (a) is practiced by: (i) partially removing weaving size and non-fibrous portions of fabric while protecting the physical look and characteristics of the fabric; (ii) closing up the fabric, allowing the dyed warp to shrink and come to the face of the fabric; (iii) removing any creasing in the fabric; (iv) softening and lubricating the fabric; and (v) shrinking and crimping the warp to further push the warp yarns to the face of the fabric and position them so that they can be rubbed and abraded.

3. A method as recited in claim 2 wherein step (i) is practiced by scouring and open-width washing of the fabric.

4. A method as recited in claim 3 wherein step (ii) is practiced by rope washing of the fabric.

5. A method as recited in claim 4 wherein step (iii) is practiced by drying the fabric under controlled tension.

6. A method as recited in claim 5 wherein step (iv) is practiced by treating the fabric with a finishing formula including wetting agent and a softener.

7. A method as recited in claim 6 wherein step (v) is practiced by compressively shrinking the fabric.

8. A method as recited in claim 7 comprising the further step of, prior to step (a), of lightly singeing the fabric to remove only long hair.

9. A method as recited in claim 8 comprising the further step, after step (b), of shrinking the fabric to stabilize the fabric to a 0–2 percent warp shrinkage range.

10. A method as recited in claim 9 wherein step (b) is practiced by sanding the tips of the warp crimp with a fine sandpaper in the range of about 50–100 grit.

11. A method as recited in claim 1 wherein step (b) is practiced by sanding the tips of the warp crimp with a fine sandpaper in the range of about 50–100 grit.

12. A method as recited in claim 1 comprising the further step of, prior to step (a), of lightly singeing the fabric to remove only long hair.

13. A method as recited in claim 1 comprising the further step, after step (b), of shrinking the fabric to stabilize the fabric to a 0–2 percent warp shrinkage range.

14. A method of producing denim fabric that has an overall look and feel of a denim garment that has been laundered, comprising raising only the warp yarn of said fabric and including the steps of:

(a) removing the long hair, only, from the denim fabric;
(b) partially removing the weaving size and non-fibrous portions while still protecting the physical look and characteristics of the fabric;
(c) closing up the fabric, allowing the dyed warp to shrink and come to the face of the fabric;
(d) removing any creasing in the fabric;
(e) softening and lubricating the fabric;
(f) shrinking and crimping the fabric to further push only the warp yarns to the face of the fabric and position them so that they can be rubbed and abraded to loosen the surface fibers;
(g) rubbing and abrading the surface of substantially all of the warp yarns at the face of the fabric with an abrasive element; and
(h) shrinking the fabric to stabilize it so that it has an appropriate warp shrinkage range.

15. A method as recited in claim 14 wherein step (b) is practiced by scouring the fabric, followed by open-width washing of the fabric.

16. A method as recited in claim 15 wherein the scouring is practiced utilizing a blend of phosphated esters with a concentration range of about 0.25–1.0 percent at a temperature within the range of about 140° F.–200° F.; and wherein said open-width washing is practiced by passing the fabric through between about 5–10 wash boxes at a speed within the range of about 30–80 yards per minute.

17. A method as recited in claim 15 wherein step (c) is practiced by subjecting the fabric to a first rope washing which completes the rinsing of detergent and size from the fabric while leaving an amount of starch and other non-fibrous material in the range of about 1.5–3.5 percent to ensure good hand development and thickness, by rope washing at 180° F. for a period of about 15–25 minutes, and then subjecting the fabric to a second rope washing at about 140° F. for a time period of about 15–25 minutes.

18. A method as recited in claim 17 wherein step (d) is practiced by drying the fabric under tension.

19. A method as recited in claim 18 wherein step (f) is practiced by compressively shrinking the fabric.

20. A method as recited in claim 19 wherein step (g) is practiced by sanding the tips of the warp crimp with a fine sandpaper in the range of about 50–100 grits, or the equivalent, in order to duplicate the surface abrasion of washing and tumble drying without making a napped or brushed type of finish or face.

21. A method as recited in claim 14 wherein step (g) is practiced by sanding the tips of the warp crimp with a fine sandpaper in the range of about 50–100 grits, or the equivalent, in order to duplicate the surface abrasion of washing and tumble drying without making a napped or brushed type of finish or face.

22. A method of producing denim fabric that has an overall look and feel of a denim garment that has been laundered, raising only the warp yarn of said fabric and including, comprising the steps of:

(a) lightly singeing the fabric;
(b) scouring the fabric
(c) open-width washing the fabric;
(d) rope washing the fabric;
(e) drying the fabric under tension;
(f) finishing the fabric;
(g) sanforizing the fabric;
(h) abrading substantially all of the tips of the warp crimp of the fabric without making a napped or brushed type finish or face; and
(i) shrinking the fabric to stabilize it at no more than 3 percent×3 percent warp and filling shrinkage.

23. A method as recited in claim 22 wherein step (h) is practiced by sanding the tips of the warp crimp on a 9 roll T-Ralph sander with 6 rolls running at a speed of about 50 ydm, utilizing a fine sandpaper in the range of about 50–100 grit or the equivalent.

24. A method as recited in claim 23 wherein step (d) is practiced by a first rope washing at a relatively high temperature for a time of approximately 15–25 minutes, and a second rope washing at a lower temperature for a time of about 15–25 minutes so as to establish the proper crimp exchange between warp and filling, and starting crimping of the warp yarns to the face of the denim fabric.

25. A denim fabric, suitable for making into garments such as pants and jackets, and produced by raising only the warp yarn of said fabric and including practicing the following steps: (a) lightly singeing the fabric; (b) scouring the fabric; (c) open-width washing the fabric; (d) rope washing the fabric; (e) drying the fabric under tension; (f) finishing the fabric; (g) sanforizing the fabric; (h) abrading substantially all of the tips of the warp crimp of the fabric without making a napped or brushed type of finish or face; and (i) shrinking the fabric to stabilize it at no more than 3 percent×3 percent warp and filling shrinkage.

26. A denim fabric, suitable for making into garments such as pants and jackets, and produced by practicing the following steps:

(a) raising the warp yarns of a piece of woven denim fabric relative to the weft yarns so that the warp crimp or loops are at the face of the fabric, and
(b) abrading only the tips of the raised crimp or loops to duplicate the surface abrasion of washing and tumble drying without making a napped or brushed type of finish or face.

27. A method of producing denim fabric that has an overall look and feel of a denim garment that has been laundered, raising only the warp yarn of said fabric and including comprising the steps of:

(a) scouring the fabric;
(b) drying the fabric under tension;
(c) finishing the fabric;
(d) compressively shrinking the fabric;
(e) abrading the tips of the warp crimp over substantially an entire face surface of the fabric without making a napped or brushed type finish; and
(f) shrinking the fabric to stabilize it at no more than 3 percent×3 percent warp and filling shrinkage.

28. A method as recited in claim 27 wherein step (e) is practiced by sanding the tips of the warp crimp on a 9 roll sander with 6 rolls running at a speed of about 50 ydm, utilizing a fine sandpaper in the range of about 50–100 grit or the equivalent.

29. A method as recited in claim 28 wherein step (a) is practiced by a first washing at a relatively high temperature for a time of approximately 15–25 minutes, and a second washing at a lower temperature for a time of about 15–25 minutes so as to establish the proper crimp exchange between warp and filling, and starting crimping of the warp yarns to the face of the denim fabric.

30. A denim fabric, suitable for making into garments such as pants and jackets, comprising only and produced by practicing the following steps:

(a) scouring the fabric;
(b) drying the fabric under tension;
(c) finishing the fabric;
(d) compressively shrinking the fabric;
(e) abrading the tips of the warp crimp over substantially an entire face surface of the fabric without making a napped or brushed type finish; and
(f) shrinking the fabric to stabilize it at no more than 3 percent×3 percent warp and filling shrinkage.

* * * * *